US009896165B2

(12) United States Patent
Neese et al.

(10) Patent No.: US 9,896,165 B2
(45) Date of Patent: Feb. 20, 2018

(54) BOAT SEAT WITH STOWABLE SEAT BACK

(71) Applicant: Grady-White Boats, Inc., Greenville, NC (US)

(72) Inventors: David A. Neese, Greenville, NC (US); Daniel Strickland, Greenville, NC (US)

( * ) Notice: Subject to any disclaimer, the term of this patent is extended or adjusted under 35 U.S.C. 154(b) by 0 days.

(21) Appl. No.: 15/397,859

(22) Filed: Jan. 4, 2017

(65) Prior Publication Data

US 2017/0190390 A1 Jul. 6, 2017

Related U.S. Application Data

(60) Provisional application No. 62/274,894, filed on Jan. 5, 2016.

(51) Int. Cl.
*B63B 29/04* (2006.01)
*B63B 17/00* (2006.01)

(52) U.S. Cl.
CPC ..... *B63B 29/04* (2013.01); *B63B 2029/043* (2013.01); *B63B 2709/00* (2013.01)

(58) Field of Classification Search
CPC ..... B63B 29/04; B63B 2709/00; B63B 2029/043
USPC ..... 114/363
See application file for complete search history.

(56) References Cited

U.S. PATENT DOCUMENTS

| | | | | |
|---|---|---|---|---|
| 2,610,329 | A * | 9/1952 | Strathaus | A47C 17/16 5/59.1 |
| 5,497,724 | A * | 3/1996 | Brown | B63B 29/04 114/343 |
| 6,230,648 | B1 * | 5/2001 | Davidson | B63B 29/04 114/363 |
| 6,945,190 | B1 * | 9/2005 | Frandsen | B63B 19/19 114/363 |
| 7,302,906 | B2 | 12/2007 | Burroughs et al. | |
| 9,021,975 | B1 | 5/2015 | Fodor et al. | |
| 2007/0158986 | A1 | 7/2007 | Adams et al. | |
| 2010/0037813 | A1 * | 2/2010 | Sahr | B63B 29/04 114/363 |

* cited by examiner

*Primary Examiner* — Anthony D Wiest
(74) *Attorney, Agent, or Firm* — Olive & Olive, P.A.

(57) ABSTRACT

A boat seat or lounge includes a stowable seat back. The stowable seat back pivots between a stowed position and a deployed position. A locking mechanism is provided for locking the seat back to the seat when in the deployed position. When stowed, the seat back pivots away from the seat and is received flush against the inner wall of the hull of a boat, to make up part of a bolster system for the cockpit of the boat.

16 Claims, 17 Drawing Sheets

BOAT SEAT WITH STOWABLE SEAT BACK

CROSS-REFERENCE TO RELATED APPLICATION

This application is related to and claims priority to provisional application Ser. No. 62/274,894 filed Jan. 5, 2016 of the same inventor herein entitled BOAT SEAT WITH STOWABLE SEAT BACK. The disclosure of Provisional Application Ser. No. 62/274,894 is expressly incorporated in its entirety by reference herein.

BACKGROUND OF THE INVENTION

1. Field of the Invention

The present invention relates to boat seats and lounges, and more particularly, to boat seats and lounges for use in performance and pleasure boats, and such boats and lounges having a stowable seat back.

2. Description of the Prior Art

A typical sun lounge and/or seat in a boat requires substantial movement of a seat cushion or support structure in order to switch between a seating configuration and a sunpad configuration which provides a flat surface on which to lay for sunbathing. The substantial movement is required, in part because the seat cushion or support structure must first be vertically lifted and then, in some cases, movement of the seat surface must occur to extend the seat surface into a larger horizontal surface flattening out what would normally have been the seat back. This is undesirable in many cases because it takes up greater amounts of space within the boat cockpit, space which may be required for quick movement within the boat cockpit.

One example of a seat with an adjustable seat back is disclosed in U.S. Patent Publication 2007/0158986 in which an adjustable sun lounge converts from a seating configuration into a sunbathing configuration. A backrest can be in a substantially horizontal position after moving from an upright position via a single pivot hinge. It should be noted that for purposes of this disclosure, the terms "seat" and "lounge" are used interchangeably and generally refer to such seats or lounges which include a backrest.

Another example of convertible prior art seats and lounges is disclosed in U.S. Pat. No. 9,021,975 which describes a seating system for marine vessels including a chair having a backrest and a seat bottom. The seating system is convertible between a forward-facing seat configuration and an aft-facing lounge configuration. In the aft-facing lounge configuration an extension element and seat bottom are substantially parallel to one another. In the forward-facing configuration, the extension element is substantially upright and at an acute angle with respect to the seat bottom. As discussed with other prior art configurations, to remove or eliminate the seat back requires an extension of the seat in length taking up further space within the boat cockpit.

The problem of having a seat back that can be removed within the environment of a boat without requiring extension of the seat with which it is associated, is overcome in accordance with the seat and system of the invention as further described herein.

BRIEF SUMMARY OF THE INVENTION

In one aspect, there is provided a seat, having a seating surface support and a seating surface, for a boat cockpit. The seat has a stowable seat back. The seat is constructed to be mounted in contact with, secured to, or adjacent an inner wall of the hull of a boat. A seat back is mounted on the seat, typically through a pivoting mechanism, to be selectively deployed and stowed.

When deployed the seat back extends, typically substantially perpendicular to the inner wall of the hull of a boat with which the seat is in contact or adjacent for providing a support for a user's back. A vertically extending rod which comprises a rotatable pivot arm is mounted on the seat support at a location proximate the inner wall of the boat hull, and also secured within the seat back at a location proximate the inner wall for supporting the seat back. The vertically extending rod is rotatable about its axis to allow the seat back to be rotated between a deployed position, and a stowed position wherein the seat back is flush against the inner wall of the boat hull. A second rod which comprises a locking arm extends downwardly from the seat back to be locked to the seat support at a female locking member when the seat back is deployed for supporting the seat back in its deployed position.

BRIEF DESCRIPTION OF THE DRAWINGS

Having thus briefly described the invention, the same will become better understood from the following detailed description made with reference to the appended figures, wherein.

DETAILED DESCRIPTION OF THE PREFERRED EMBODIMENTS

Having generally described the invention and the figures, the invention will become more clearly evident from the following detailed discussion of embodiments thereof presented herein.

Figure 1:
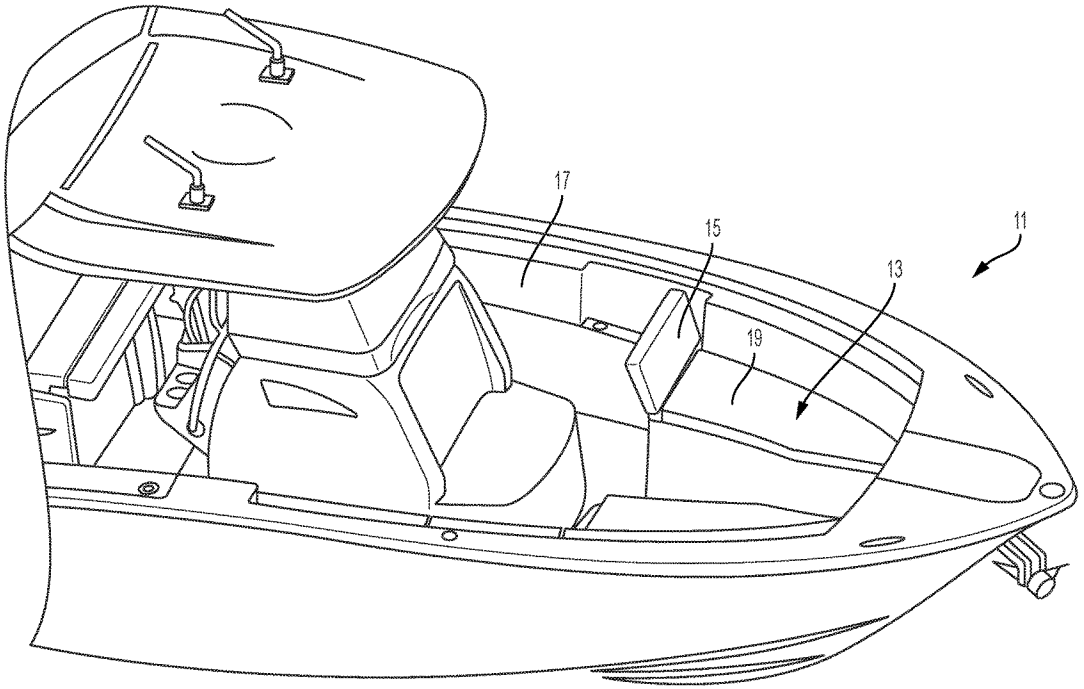
FIG. 1 is a perspective view of a boat having a seat or lounge in the cockpit thereof with a stowable seat back shown in a deployed position.
Figure 2:
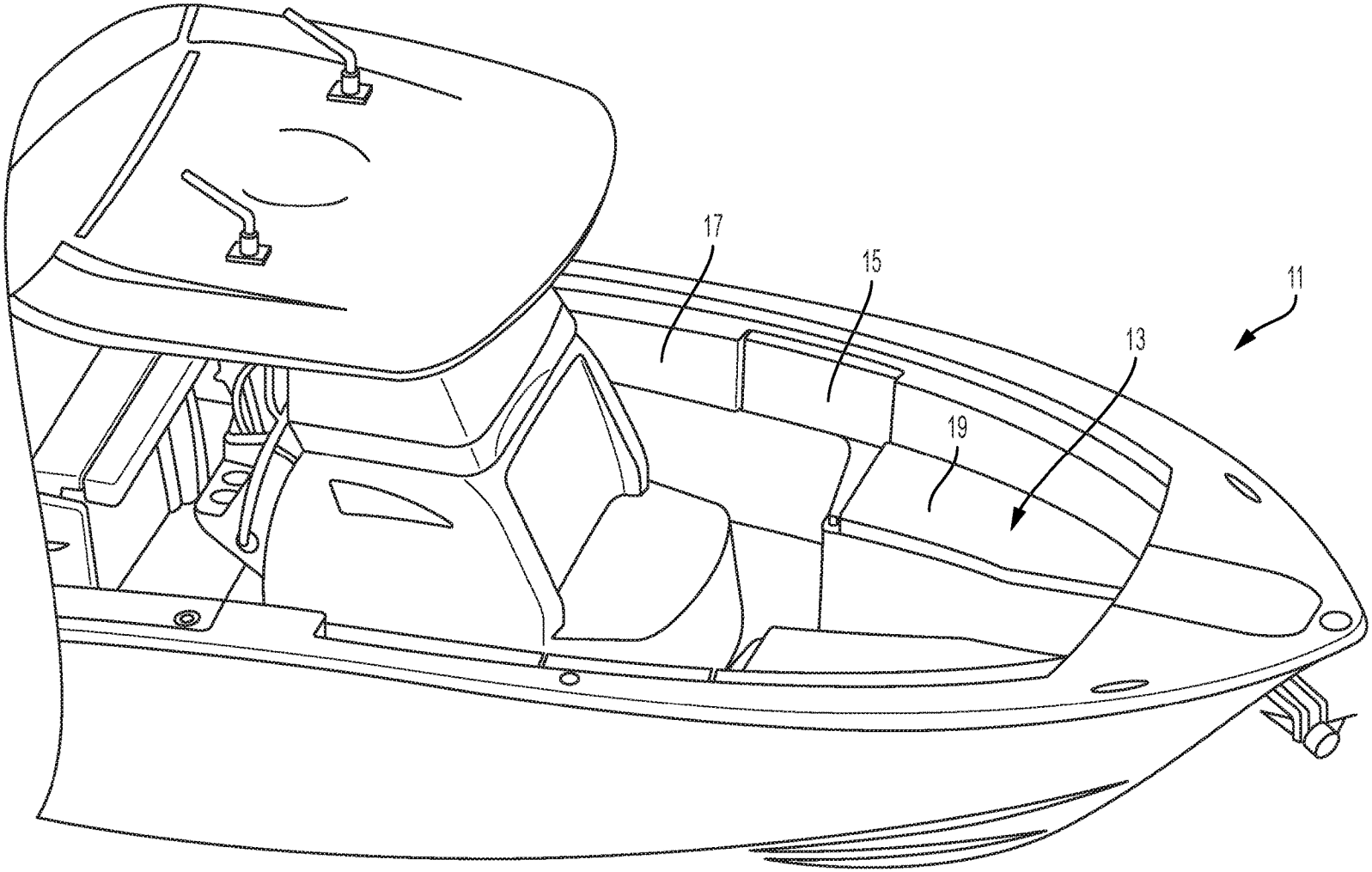
FIG. 2 is a view like that of FIG. 1 but showing the stowable seat back in a stowed position.

A boat seat 13 with a stowable seat back 15 is generally illustrated in FIGS. 1 and 2 as assembled within the cockpit of a boat 11. In FIG. 1 a stowable seat back 15 is shown deployed for use, and in FIG. 2 the stowable seat back 15 is shown in stowed position to make up part of a bolster system 17. The seat 13 is an assembly of elements as described herein, and includes a seating surface 19 on a seating surface support (not numbered).

Figure 3:
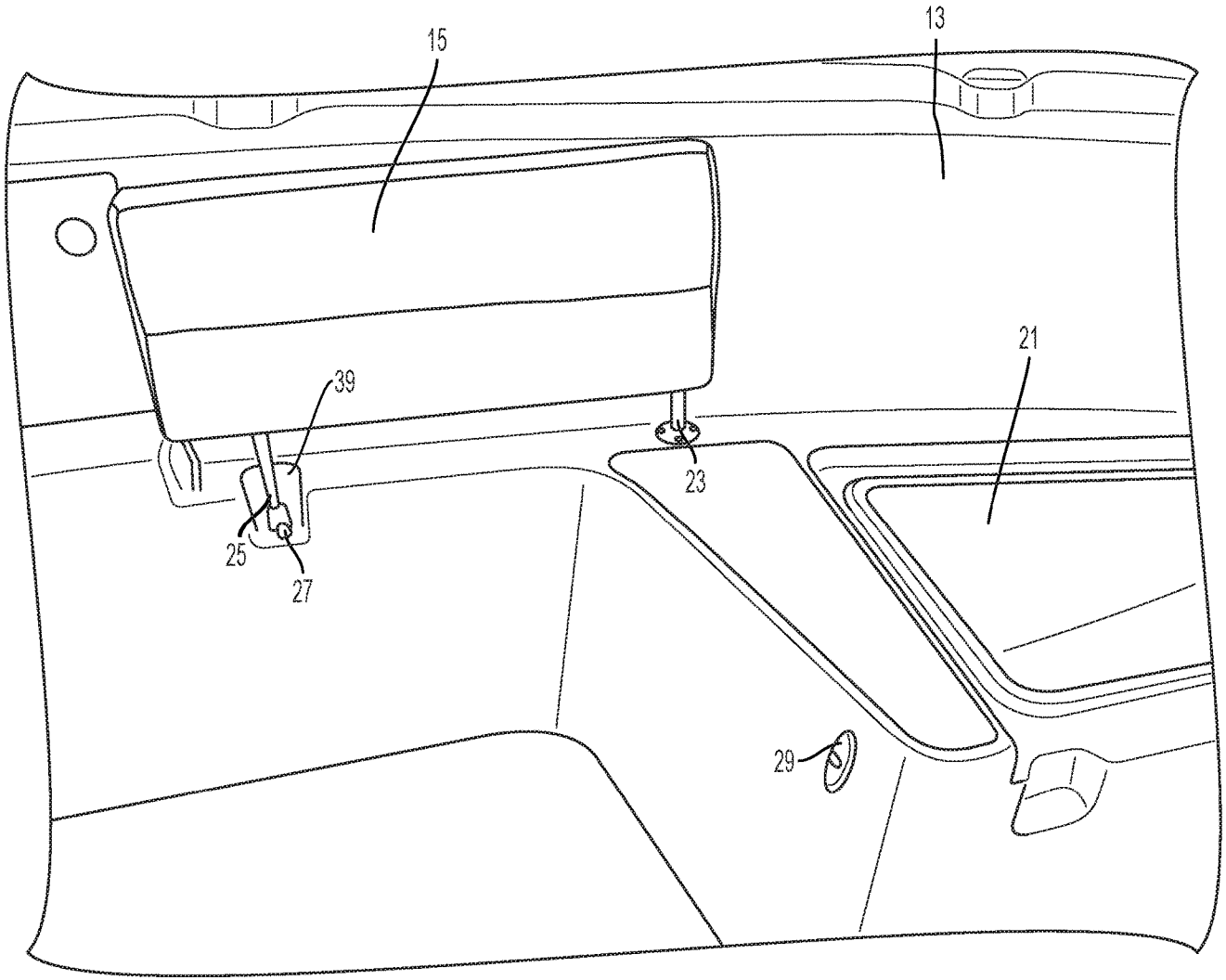
FIG. 3 is an enlarged perspective view within a boat cockpit showing the seat back and its various components in a stowed position.

FIG. 3 illustrates in greater detail the seat 13 and stowable seat back 15 shown with the seating surface 19 removed to reveal a storage compartment 21 underneath where the seating surface 19 is normally located. In this embodiment the stowage compartment 21 makes up the seating surface support. The stowable seat back 15 is supported at a location proximate and in abutment with the inner wall of the hull of the boat 11 through a pivot arm 23, which is rotatable about its axis. There is also shown a locking arm 25 with a male locking projection 27 which, when the seat back 15 is rotated into a deployed position, engages with female locking member 29 mounted on the seating surface support, e.g., stowage compartment 21 for locking the seat back 15 in a deployed position.

FIG. 3 also illustrates a recessed cutout 39 on a portion of the inner wall of the hull for receiving locking arm 25 allowing the seat back 15 to be stowed flush against the inner wall to form part of bolster system 17.

Figure 4:
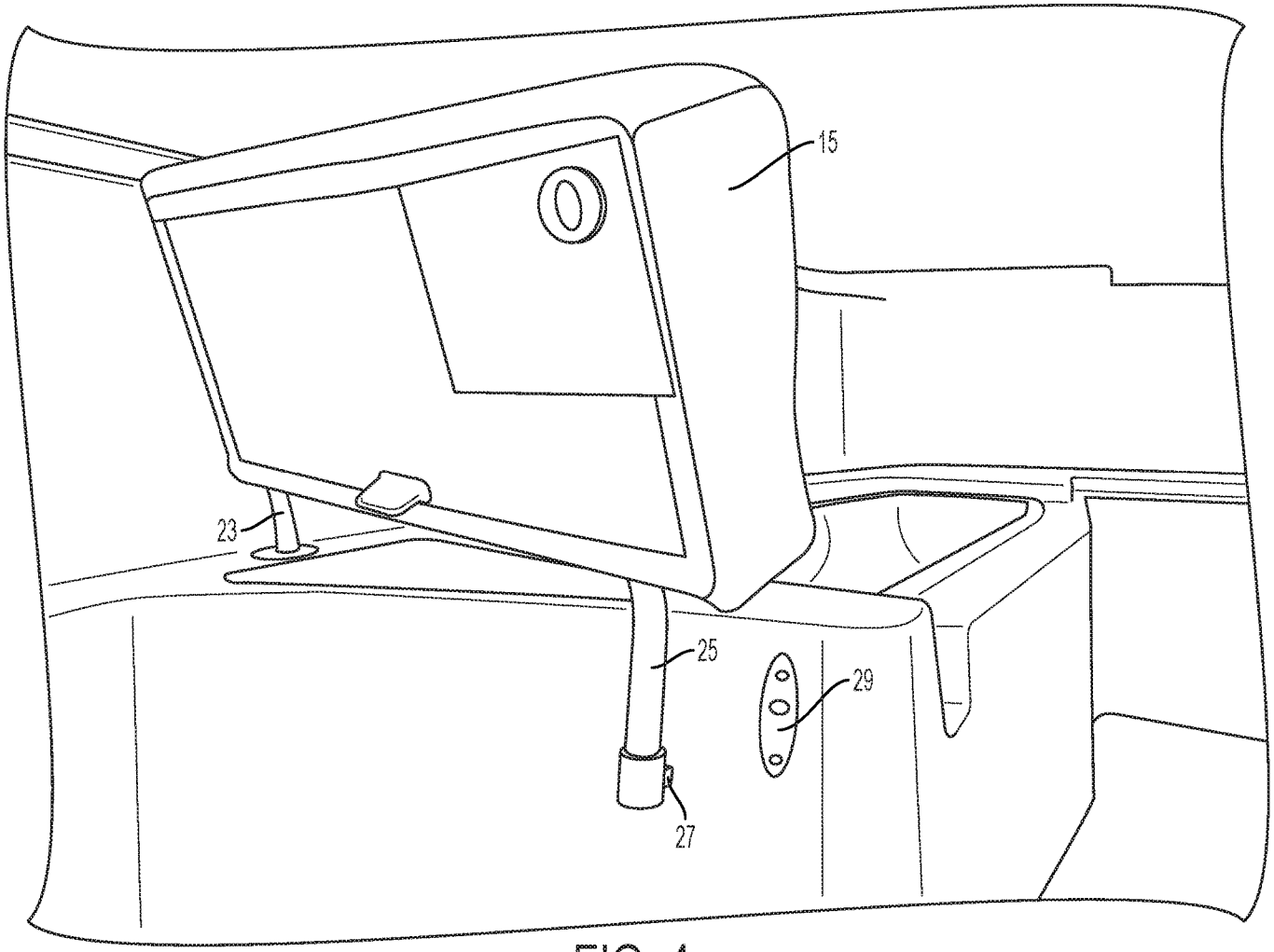
FIG. 4 is a perspective view showing a locking arm extending from the seat back to be locked onto a seat assembly when the seat back is in a deployed position.

FIG. 4 illustrates in greater detail the locking mechanism in which the locking arm 25 can be moved to have the male locking projection 27 pass into a receiving aperture of female locking member 29 to deploy the seat back 15.

Figure 5:
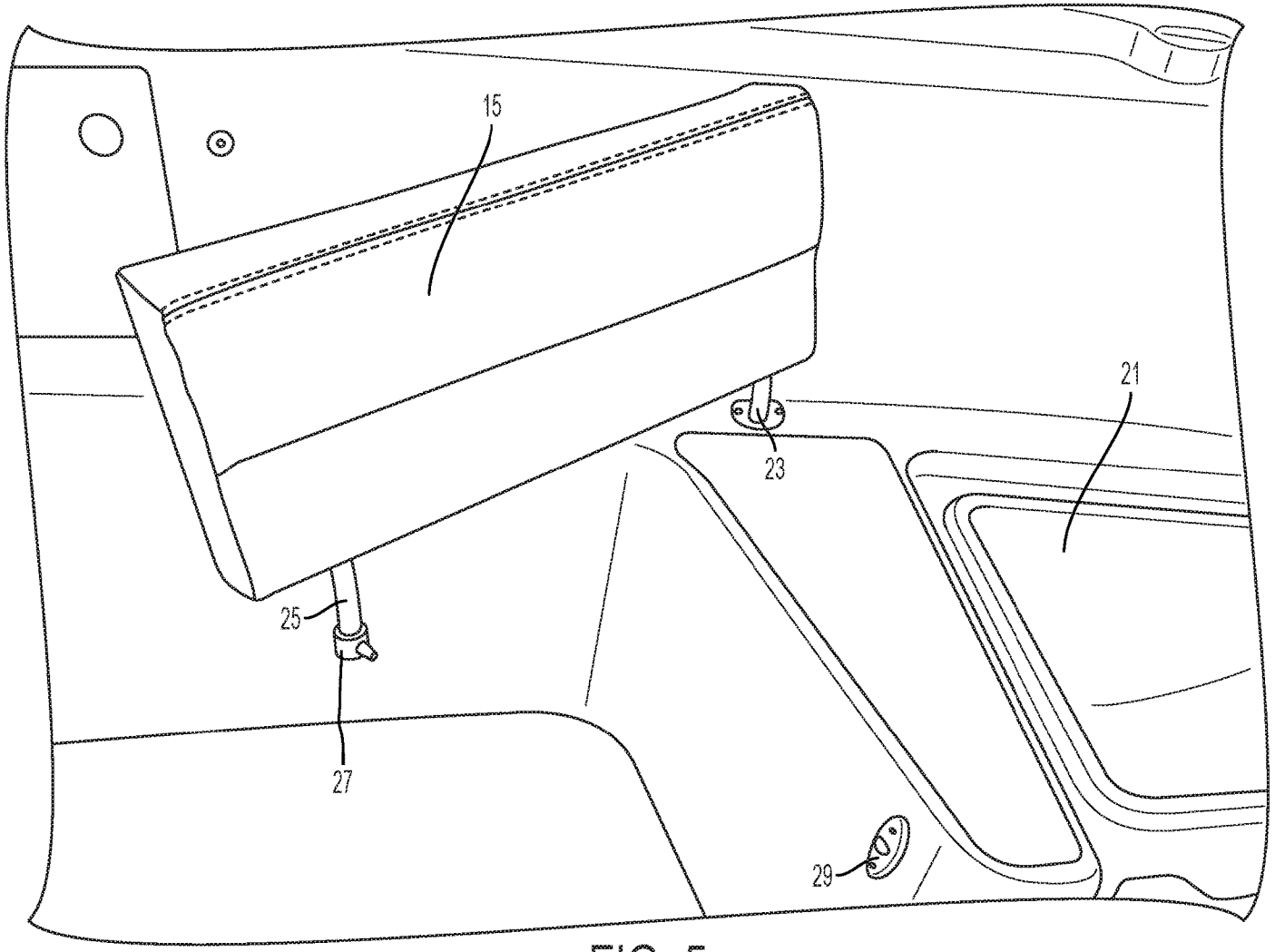
FIG. 5 is a perspective view showing the seat back in accordance with the invention in movement between a stowed position and a deployed position.

FIG. 5 illustrates in perspective view the stowable seat back 15 being moved from a stowed position into a deployed position.

Figure 6:
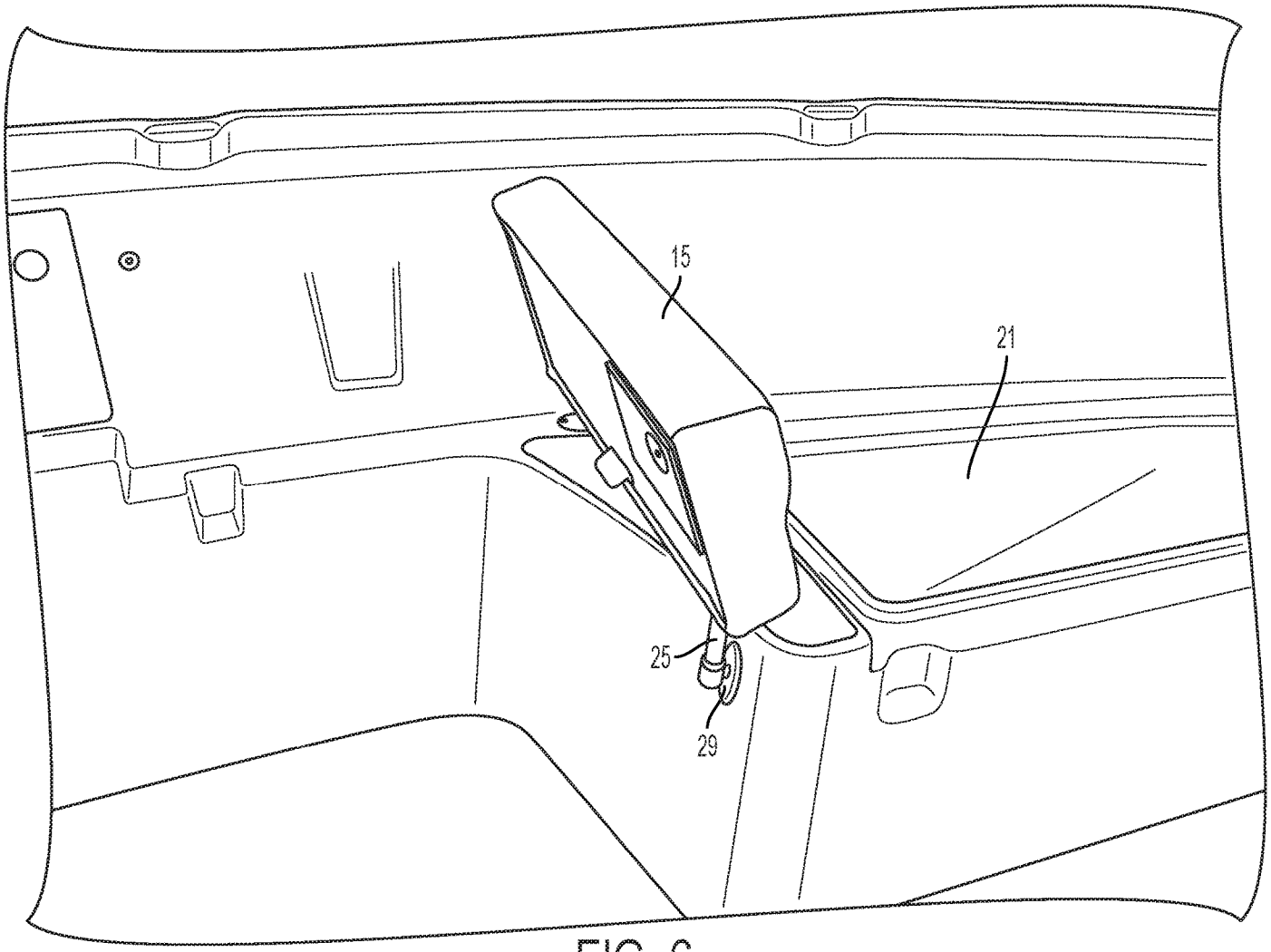
FIG. 6 shows the seat back in accordance with the invention in a deployed position locked onto the seat assembly.

FIG. 6 shows the seat back 15 moved completely into a deployed position with the locking arm 25 engaged with the female locking member 29 through entry of the male locking projection 27 into a recess in the female locking member 29.

Figure 7:
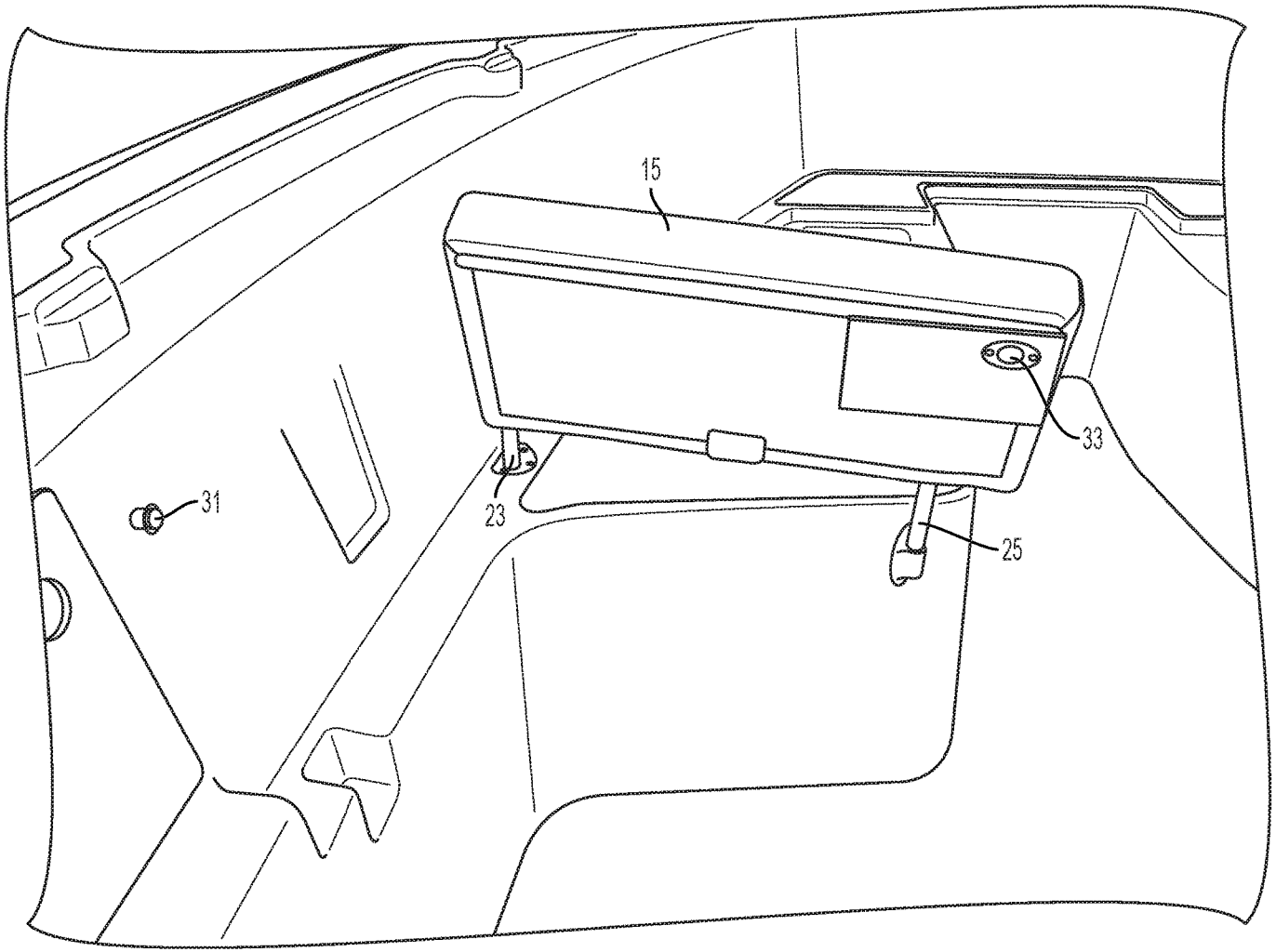
FIG. 7 is a view similar to that of FIG. 6 showing the seat back in a deployed position.

FIG. 7 is a view from the back of the seat back 15, with the seat back 15 in a deployed position, and further illustrating a male stow-lock member 31 on the inner wall of the hull which is received within female stow-lock member 33 on the back of the seat back 15 when the seat back 15 is stowed. More specifically, the two members 31 and 33 lock with each other to prevent the seat back 15 from swinging freely away from the inner wall of the hull.

Figure 8:
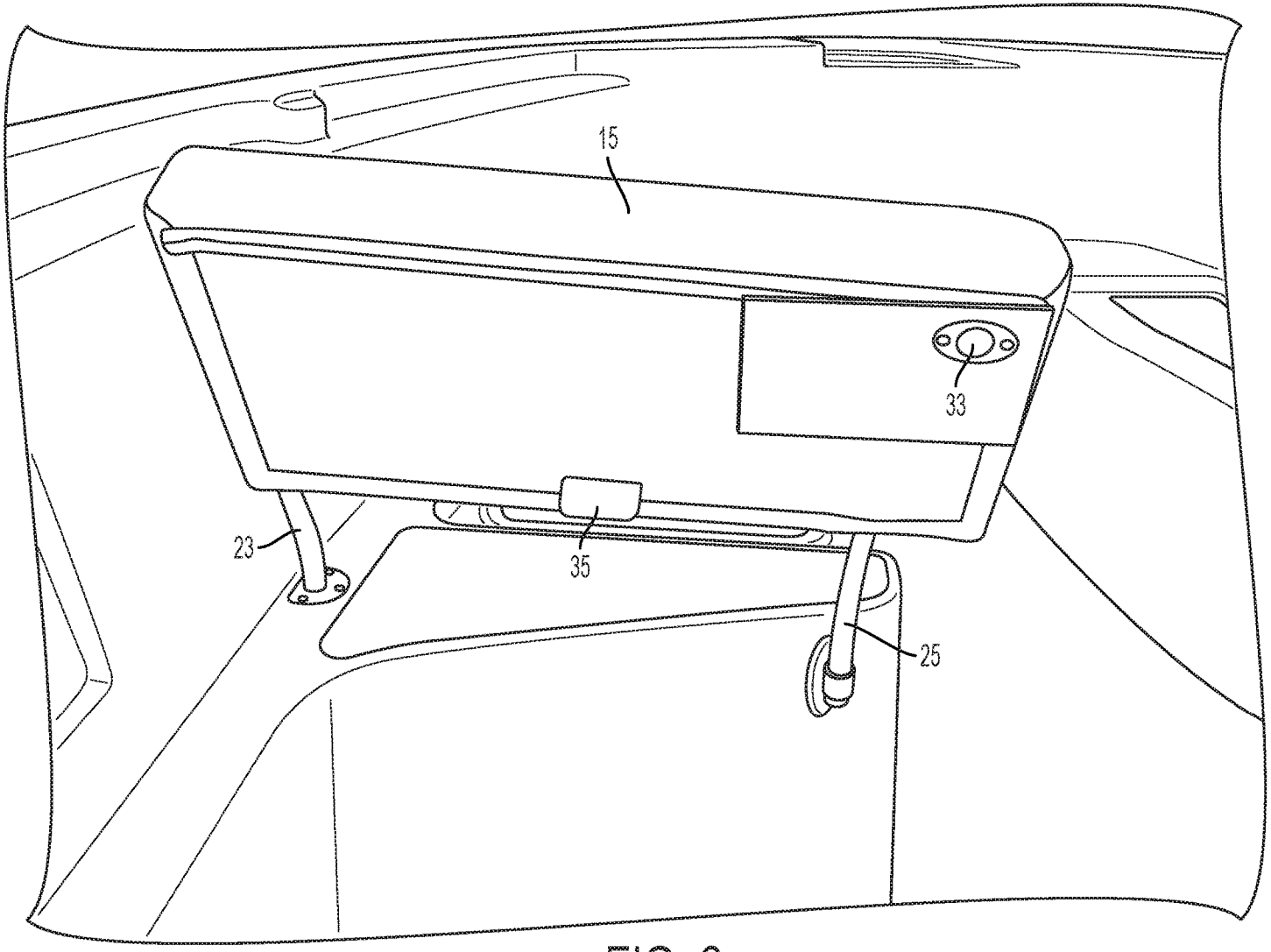
FIG. 8 is a view similar to that of FIG. 7, but showing the seat back deployed and raised.

FIG. 8 illustrates a paddle latch 35 which is connected to an internal mechanism within the seat back 15, which allows the seat back 15 to be moved between an elevated position and a lowered position. As will be appreciated, the internal mechanism is conventional and allows the seat back 15 to slide up and down pivot arm 23 and locking arm 25.

Figure 9:
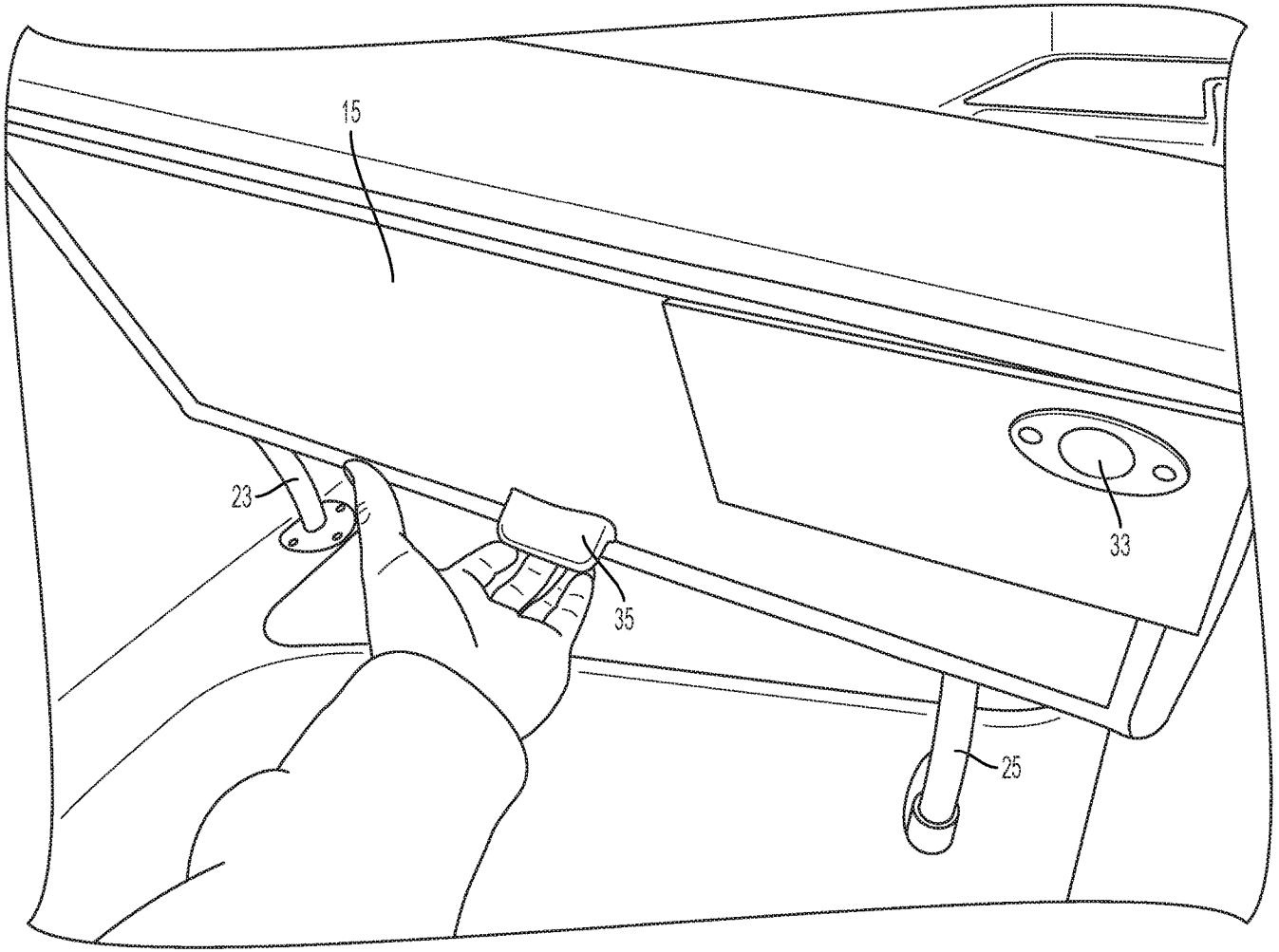
FIG. 9 illustrates how the seat back can be moved between a lower position to a higher position and showing the seat back in its higher position.

FIG. 9 illustrates how the paddle latch 35 is engaged by a user to raise the seat back 15.

Figure 10:
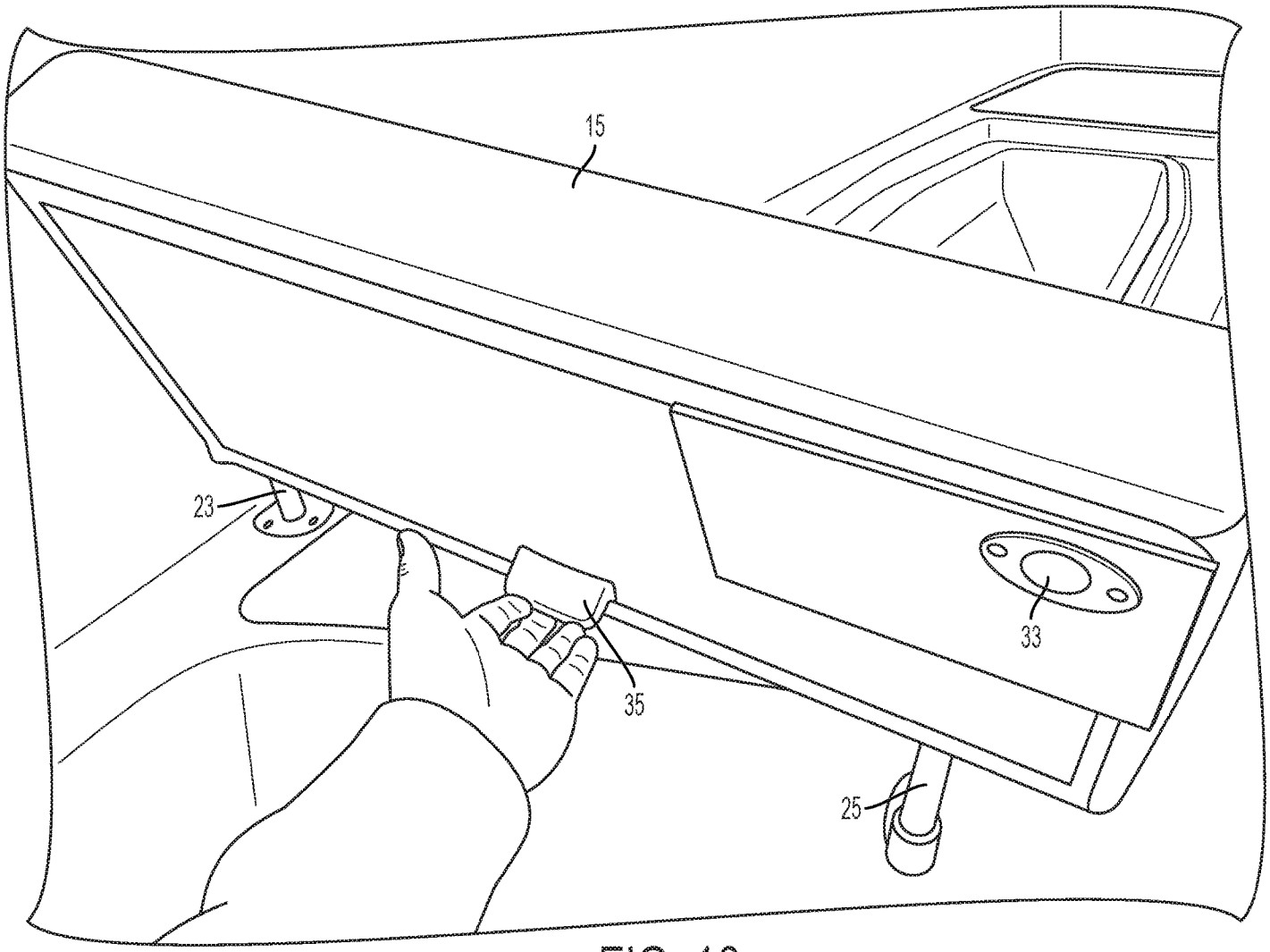
FIG. 10 shows the seat back in its lower position.

FIG. 10 illustrates how the paddle latch 35 can be used to move the seat back 15 into a lower position.

Figure 11:
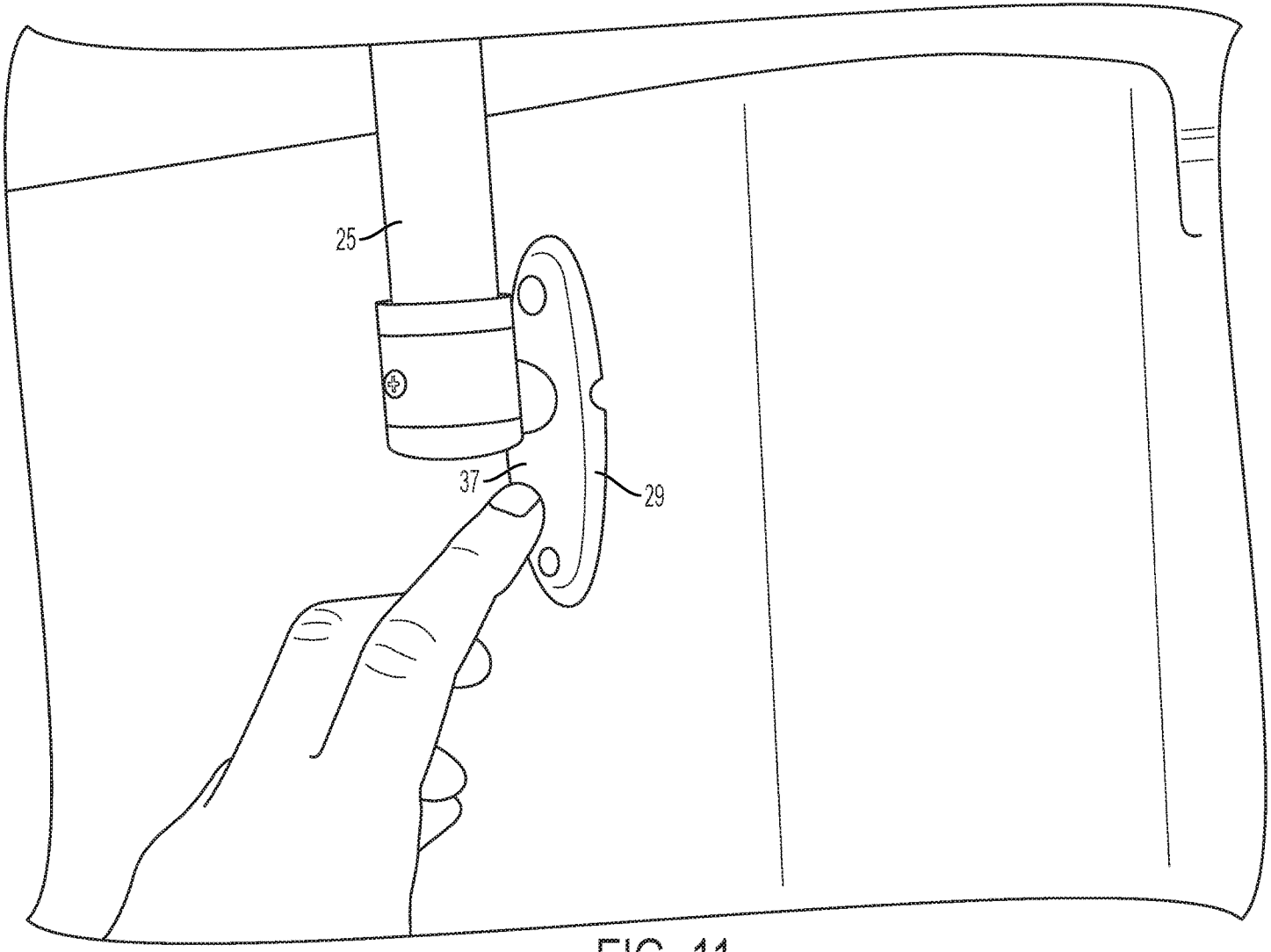
FIG. 11 shows the locking mechanism for locking the seat back to the seat assembly in its deployed position.

FIG. 11 is an enlarged view showing the locking arm 25 engaged with the female locking member 29. The female locking member 29 includes a spring loaded slide catch 37 which, when the male locking projection 27 of the locking arm 25 is received within the aperture of the female locking member 29, serves to engage the male locking projection 27 in a locked manner.

Figure 12:
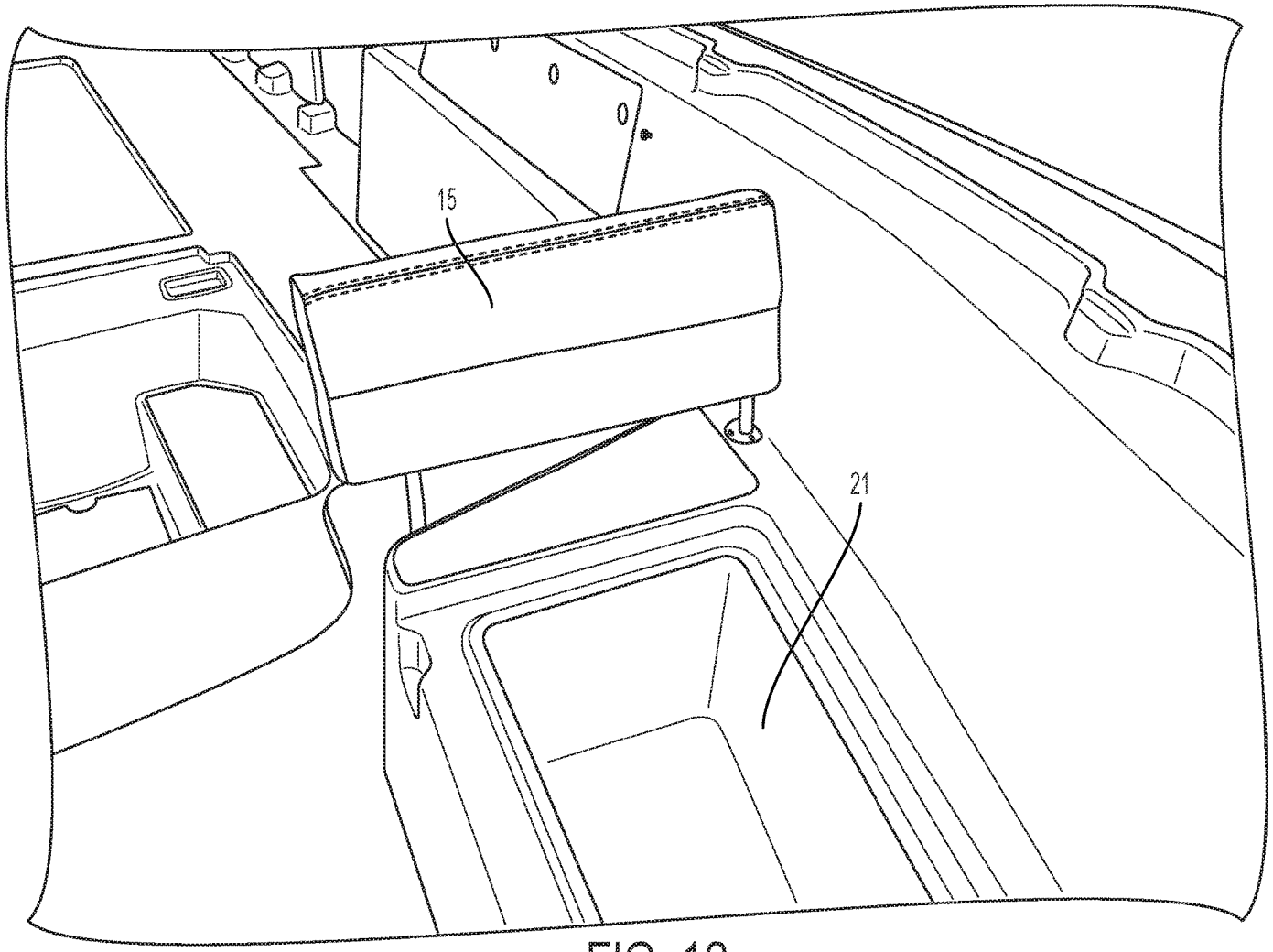
FIG. 12 is a view from the front of the seat back showing the seat back in a deployed position.

FIG. 12 is a perspective view from the front of the seat assembly and shows the seat back 15 in a deployed position shown without the seating surface 19 on the seating surface support, e.g. stowage compartment 21, and showing the storage compartment 21, which is below the seating surface 19.

Figure 13:
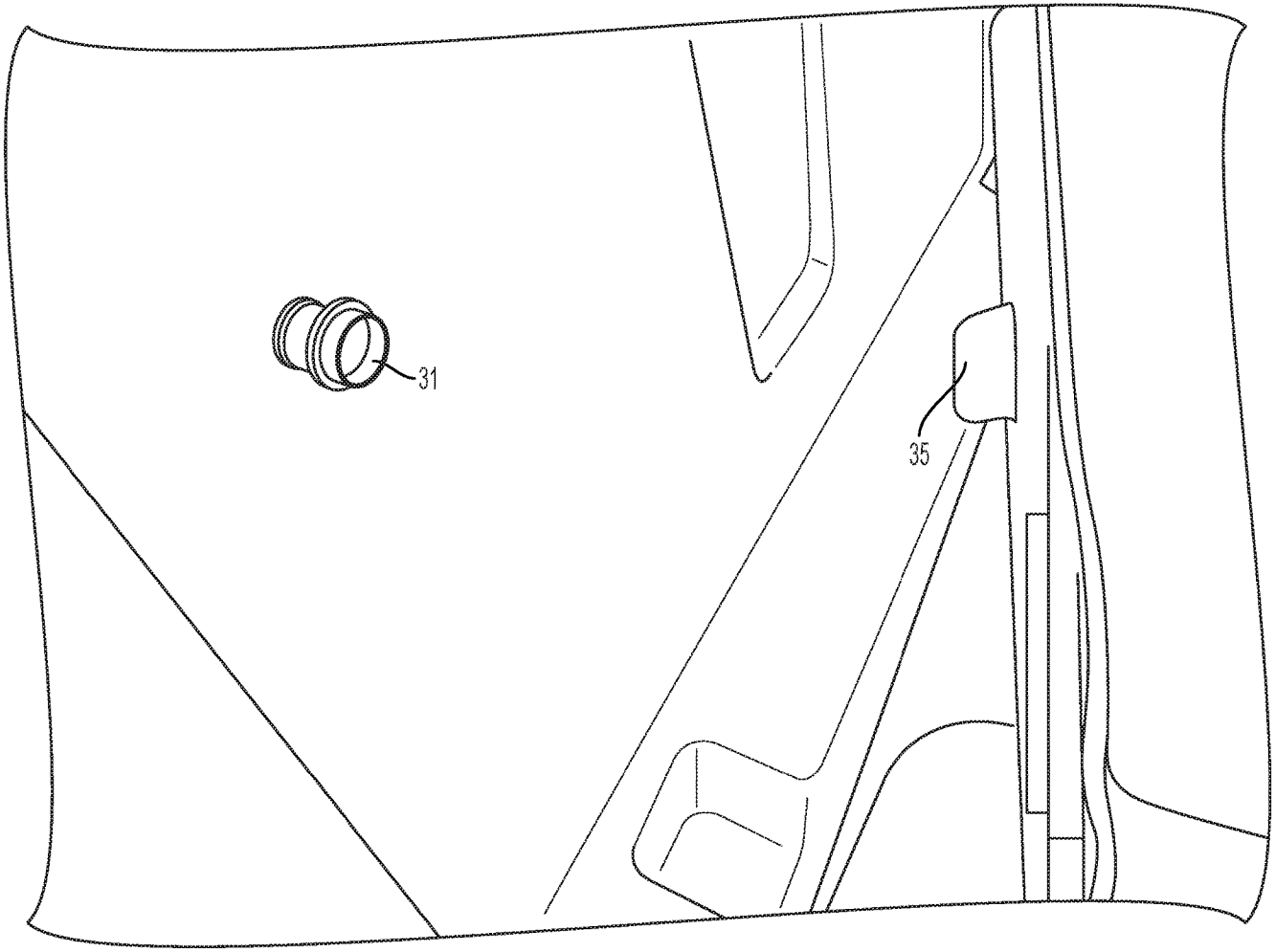
FIG. 13 is a perspective view showing a male stow-lock member for locking the seat back against the boat cockpit inner wall.
Figure 14:
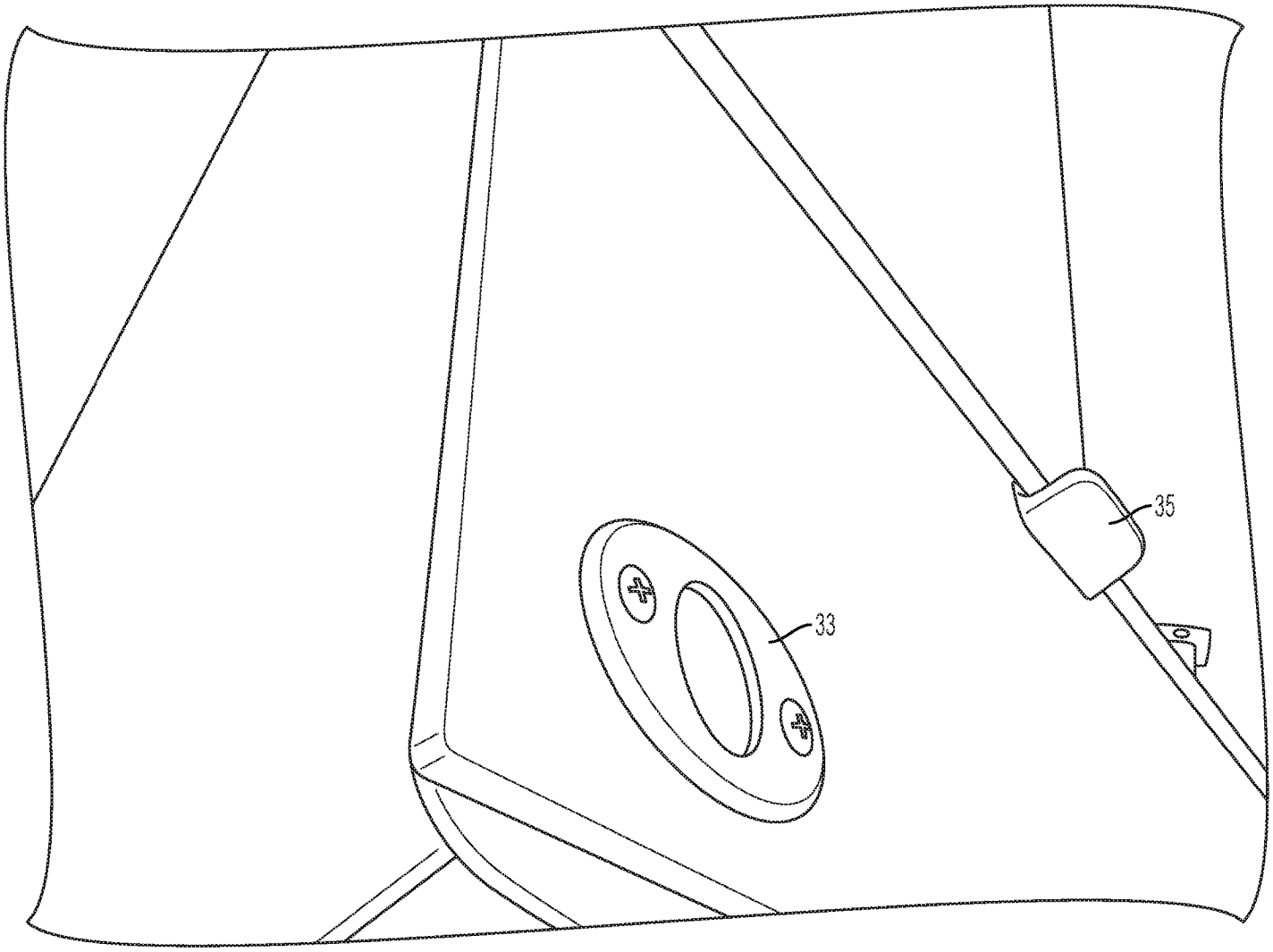
FIG. 14 is a perspective view showing a female stow-lock member which engages with the male stow-lock member for locking the seat back in a stowed position.

FIG. 13 is an enlarged view of the male stow-lock member 31, which is secured to the inner wall of the hull for locking the seat back 15 in a stowed position. The enlarged portion of the male stow-lock member 31 is typically made of an elastomeric material such as rubber, which can be press-fit into the female stow-lock member 33 which is attached to the back of the seat back 15 as more clearly shown in FIG. 14.

Figure 15:
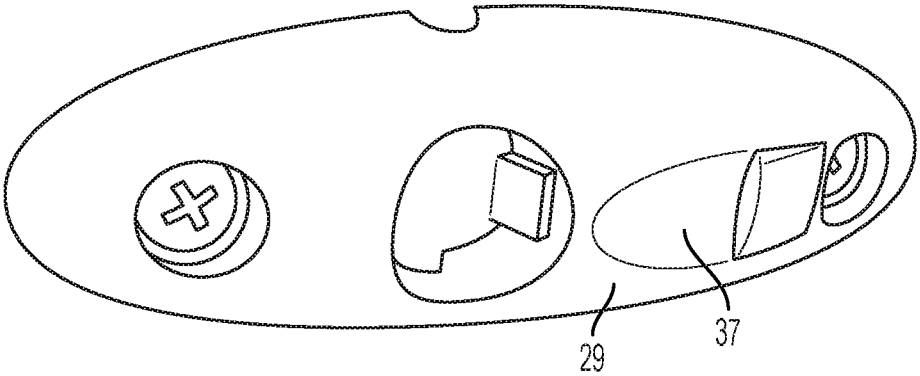
FIG. 15 is an enlarged view showing a female receiver lock with a slide catch for locking the seat back in a deployed position.

FIG. 15 illustrates in an enlarged view the female locking member 29 with a spring loaded slide catch 37 to engage the male locking projection 27 on the locking arm 25.

Figure 16:
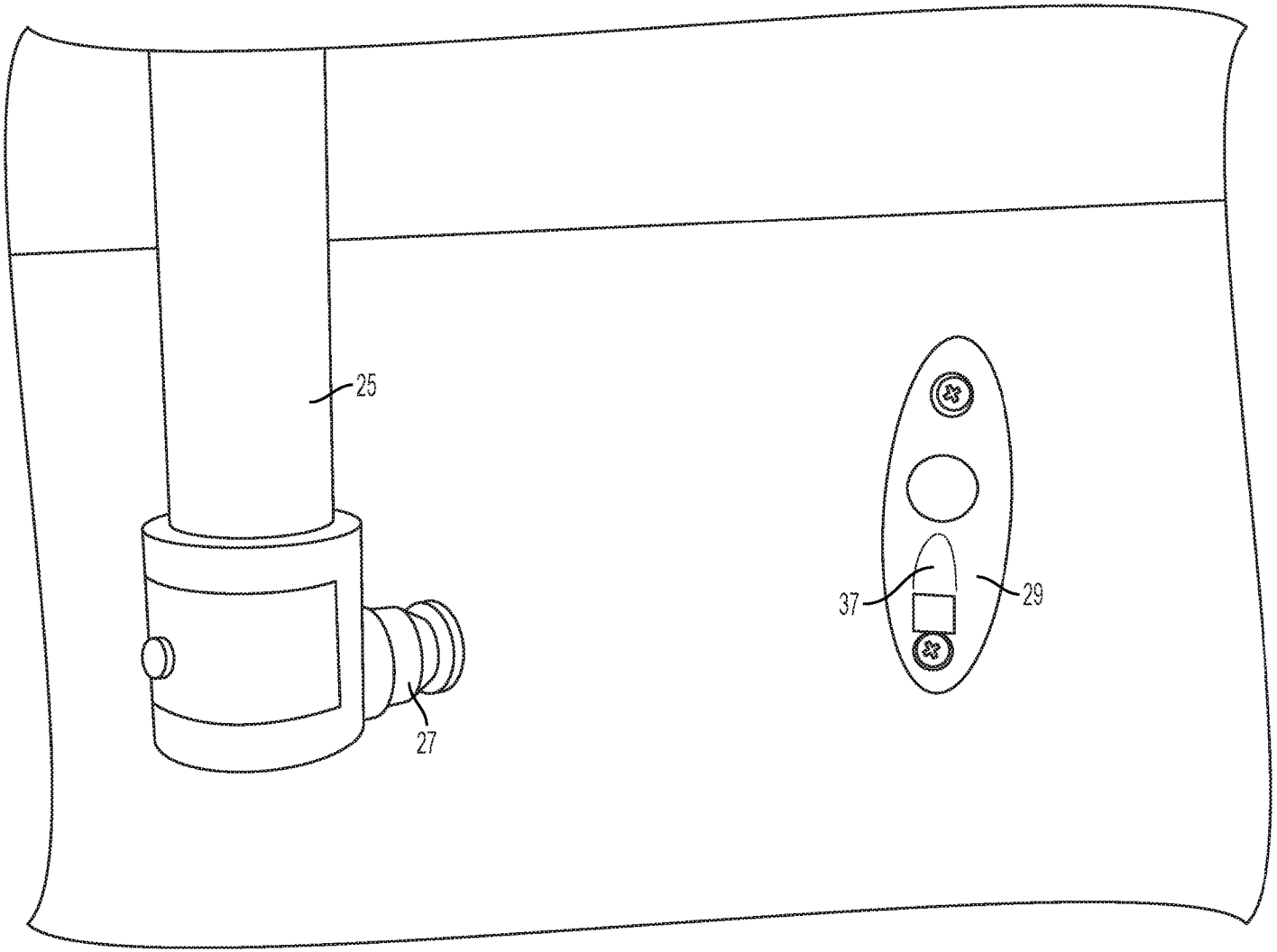
FIG. 16 is an enlarged view showing the locking arm with a male locking projection which is received within a female receiver lock when the seat back is deployed.

FIG. 16 is an enlarged view of the locking arm 25 and female locking member 29 with a spring loaded slide catch 37. The male locking projection 27 is shown enlarged in this figure, and includes a slot region which is engaged with the spring loaded slide catch 37 when the male locking projection 27 is received within the aperture of the female locking member 29.

Figure 17:
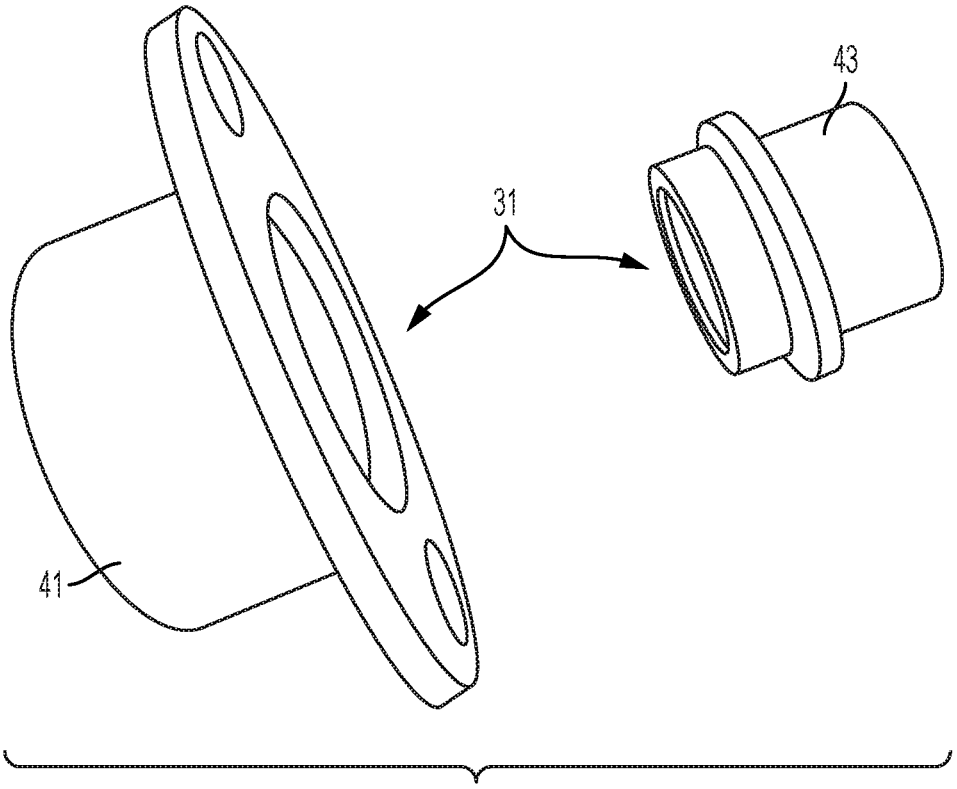
FIG. 17 is an enlarged view showing in disassembled form the parts making up the male stow-lock member for securing the seat back when it is in a stowed position.

FIG. 17 illustrates in a disassembled view the male stow-lock member 31 which includes the enlarged elastomeric portion 41, which is received within the female stow-lock member 33, and includes a connection member 43 which when assembled allows the male stow-lock member 31, to be secured to the inner wall of the hull of a boat 11.

While this invention has been described as having exemplary designs, the present invention may be further modified within the spirit and scope of this disclosure. This application is therefore intended to cover any variations, uses, or adaptations of the invention using its general principals. Further, this application is intended to cover such departures from the present disclosure as come within the known and customary practice in the art to which this invention pertains.

What is claimed is:

1. A boat seat, comprising;

a seating surface support mounted in a cockpit of a boat adjacent an inner wall of a hull of the boat;

a seating surface supported by the seating surface support; and a seat back attached on the seating surface support through a pivoting mechanism, said pivoting mechanism comprises a rotatable pivot arm capable of rotating about its axis, said rotatable pivot arm extending into said seat back at a location of the seat back adjacent the inner wall of the boat cockpit, and extending into the seating surface support at the location adjacent the inner wall of the boat cockpit for rotating the seat back between a deployed position forming a back support for a user seated on a seat, and a stowed position wherein the seat back is held against and in contact with the inner wall of the hull of the boat.

2. The boat seat of claim 1, further comprising a female locking member on the seating surface support, and a locking arm on the seat back for locking the seat back to the seating surface support when in the deployed position by locking the locking arm to the female locking member.

3. The boat seat of claim 2, wherein the locking arm has a male locking projection and the female locking member has an aperture for receiving the male locking projection.

4. The boat seat of claim 3, further comprising a male stow-lock member on the inner wall of the hull and a corresponding female stow-lock member on a back of the seat back for securing the seat back to the inner wall of the boat and when the seat back is not deployed.

5. The boat seat of claim 2, further comprising a male stow-lock member on the inner wall of the hull and a corresponding female stow-lock member on a back of the seat back for securing the seat back to the inner wall of the boat when the seat back is not deployed.

6. The boat seat of claim 1, further comprising a male stow-lock member on the inner wall of the hull and a corresponding female stow-lock member on a back of the seat back for securing the seat back to the inner wall of the boat and when the seat back is not deployed.

7. The boat seat of claim 1, wherein the seating surface support comprises a storage compartment.

8. The boat seat of claim 1, further comprising a mechanism for raising and lowering the seat back between a highest height position and a lowest height position.

9. A boat seat comprising;

A seating surface support mounted in a cockpit of a boat adjacent an inner wall of a hull of the boat; and a seat back attached to the seating surface support through a pivoting mechanism, said pivoting mechanism comprises a rotatable pivot arm capable of rotating about its axis, said rotatable pivot arm extending into said seat back at a location of the seat back adjacent the inner wall of the boat cockpit, and extending into the seating surface support at the location adjacent the inner wall of the boat cockpit for rotating the seat back between a deployed position forming a back support for a user seated on a seat, and a stowed position wherein the seat back is held against and in contact with an inner wall of a hull of a boat.

10. The boat seat of claim 9, further comprising a female locking member on the seating surface support, and a locking arm on the seat back for locking the seat back to the seating surface support when in the deployed position by locking the locking arm to the female locking member.

11. The boat seat of claim 10, wherein the locking arm has a male locking projection and the female locking member has an aperture for receiving the male locking projection.

12. The boat seat of claim 11, further comprising a male stow-lock member on the inner wall of the hull and a corresponding female stow-lock member on the back of the seat back for securing the seat back to the inner wall of the boat when the seat back is not deployed.

13. The boat seat of claim 9, further comprising a male stow-lock member on the inner wall of the hull and a corresponding female stow-lock member on the back of the seat back for securing the seat back against the inner wall of the boat when the seat back is not deployed.

14. The boat seat of claim 9, wherein the seating surface support comprises a storage compartment.

15. The boat seat of claim 14, further comprising a seating surface on the seating surface support.

16. The boat seat of claim 9, further comprising a mechanism for raising and lowering the seat back between a highest height position and a lowest height position.

* * * * *